United States Patent [19]

Bartow

[11] 4,374,550

[45] Feb. 22, 1983

[54] UPRIGHT FOR LIFT TRUCK

[75] Inventor: Richard J. Bartow, Athens, Mich.

[73] Assignee: Clark Equipment Company, Buchanan, Mich.

[21] Appl. No.: 202,099

[22] Filed: Oct. 30, 1980

Related U.S. Application Data

[63] Continuation of Ser. No. 17,779, Mar. 8, 1979, abandoned, Continuation-in-part of Ser. No. 842,765, Oct. 17, 1977, abandoned.

[51] Int. Cl.[3] ..... B66B 9/20

[52] U.S. Cl. ..... 187/9 E; 414/631

[58] Field of Search ..... 187/9 E, 9 R, 95; 414/631, 629, 641, 647, 635, 785

[56] References Cited

U.S. PATENT DOCUMENTS

| | | | |
|---|---|---|---|
| 2,456,320 | 12/1948 | Rapke | 187/9 E |
| 3,360,078 | 12/1967 | Hopfeld | 187/9 E |
| 3,394,778 | 7/1968 | Brinton | 187/9 E |
| 3,830,342 | 8/1974 | Allen | 187/9 E |

FOREIGN PATENT DOCUMENTS

| | | | |
|---|---|---|---|
| 2020276 | 11/1971 | Fed. Rep. of Germany | 187/9 R |

OTHER PUBLICATIONS

Robinson; "Double Asymmetric Upright".

*Primary Examiner*—Joseph J. Rolla
*Assistant Examiner*—Kenneth Noland
*Attorney, Agent, or Firm*—J. C. Wiessler

[57] ABSTRACT

A lift truck upright having a fixed upright section, one or more telescopic upright sections, and a load carrier mounted on an inner upright section. An asymmetric lift cylinder assembly is located adjacent one side or the upright in a position which provides improved overall operator visibility through the upright. The lift cylinder is adapted to be operatively connected at its upper end to a telescopic upright section for operating lifting chain structure which traverses laterally across the upright and which is reeved on spaced and rotationally aligned sprockets supported either from a telescopic upright section or from the lift cylinder assembly, the one chain end structure being connected in the two stage upright hereof a substantial distance outwardly of one side of the cylinder assembly to a member, such as to the adjacent outer upright rail, and the other chain end structure being connected centrally of the lifting or fork carriage. The cylinder assembly is operatively connected to the telescopic upright section at or near a location which is one-half the projected distance between the chain end connections, or in a broader sense, approximately midway between the vertical central plane of the load carrier and the chain end connection outwardly of the cylinder assembly.

In any multi-section upright using this invention, the asymmetric cylinder assembly is located such that it projects at least partially into the area of interference by the adjacent side of the upright when in a retracted or collapsed position with the visibility of the operator from his normal line of sight through that side of the upright.

42 Claims, 17 Drawing Figures

UPRIGHT FOR LIFT TRUCK

CROSS-REFERENCE TO RELATED APPLICATION

This is a continuation of application Ser. No. 17,779, filed Mar. 8, 1979 now abandoned, which is a continuation-in-part of application Ser. No. 842,765, filed Oct. 17, 1977 now abandoned. The present application is the parent application to my commonly assigned co-pending continuation-in-part applications Ser. Nos. 28,292, 28,308 and 28,614, all filed on Apr. 9, 1979, as well as to copending application Ser. No. 176,742, filed Aug. 11, 1980, which is a continuation of continuation-in-part application Ser. No. 28,291, filed Apr. 9, 1979.

BACKGROUND OF THE INVENTION

In lift trucks of the type contemplated it has been one of the most persistent problems encountered in the art over the years to provide an upright construction which both affords the operator of the truck good visibility through the upright and which is of relatively simple and low cost construction, particularly in triple and quad stage uprights. Heretofore various means have been devised for improving, or which may incidentally improve, operator visibility through telescopic uprights in lift trucks, including upright structures such as are disclosed in U.S. Pat. Nos. 2,394,458, 2,456,320, 2,855,071, 3,394,778, 3,830,342, and German Patents 1,807,169 and 2,920,276, but none have satisfied adequately the above criteria.

Summary

My invention is a major step forward in the art over any prior known telescopic upright structure for lift trucks in which operator visibility through the upright and relative simplicity and low cost are of importance. In particular my invention provides an asymmetric lift cylinder assembly connected, or adapted to be operatively connected under certain conditions, at its upper end to a telescopic upright section and located adjacent one side of the upright in such a manner that it projects at least partially into the area of interference by the adjacent side of the upright when in a retracted or collapsed position with the visibility of the operator from his normal line of sight through that side of the upright. The cylinder assembly operates a flexible lifting element (chain) which is reeved to traverse across a portion of the upright on a pair of rotationally aligned spaced sheaves or sprockets wheel elements supported from the one telescopic section or from the lift cylinder assembly. One end of the flexible lifting element, as disclosed, is connected substantially centrally of a load carrier mounted for elevation on the one telescopic section and the other end structure of the flexible lifting element is connected to a relatively fixed member outwardly of the one side of the cylinder assembly, the cylinder assembly being connected or adapted to be operatively connected to the one telescopic section at or near a location which is one-half the projected distance between the end connections of the flexible lifting elements. In a broader sense, the cylinder assembly is operatively connected to the one section approximately midway between the vertical central plane of the load carrier and the connection of the flexible element outwardly of the cylinder assembly.

It is an important principle of the invention that the lifting force of the asymmetric cylinder and associated structure apply at least approximately balanced lifting force moments on the upright structure in the transverse plane of the upright.

It is a primary object of the invention to provide improved and novel upright structures for use on lift trucks and the like in which improved operator visibility is provided through the upright.

Another important object is to provide improved operator visibility in such upright structures while providing an upright of relative simplicity and low cost.

Other objects, features and advantages of the invention will readily appear to persons skilled in the art from the detailed description of the invention which follows.

DETAILED DESCRIPTION

Figure 1:
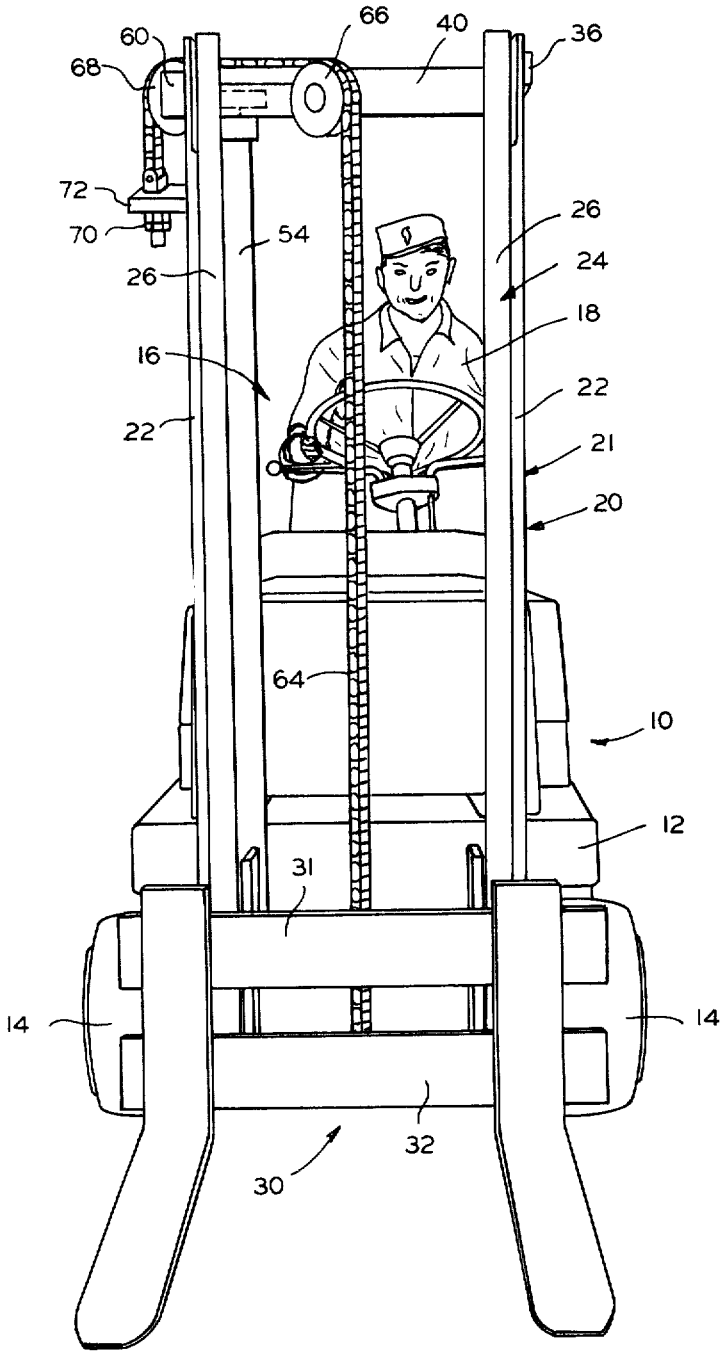
FIG. 1 is a front view of an industrial lift truck showing a load carriage lowered to the bottom of the telescopic upright section of a two-stage upright, and exemplifying the improved operator visibility which is provided through the upright.

Referring to the drawing, and first to FIGS. 1–4, a conventional industrial lift truck is shown at numeral 10 having a frame and body construction 12 mounted on a pair of steering wheels, not shown, at the rear end thereof and a pair of traction wheels 14 forwardly thereof, and embodying suitable power components which may be either electric or gas for operating the truck from an operator's compartment 16. An operator is illustrated in FIG. 1 at numeral 18 as he would appear when operating the truck to an observer in front of the truck.

The upright assembly of the present invention is illustrated generally at numeral 20, the assembly being mounted on the truck in known manner. A fixed mast section 21 includes a pair of transversely spaced opposed channel members 22 arranged to receive a single telescopic mast section 24 formed of two laterally spaced I-beams 26, mast section 24 being guide roller supported in mast section 21 and arranged for longitudinal movement relative thereto. A load or fork carriage 30 having a pair of transverse support plates 31 and 32 is guide roller mounted in known manner for elevation in the telescopic upright section.

Mast section 21 is cross-braced for rigidity by means of upper and lower transverse brace members 36 and 38, and telescopic section 24 is cross-braced by upper and lower transverse members 40 and 42.

Figure 3:
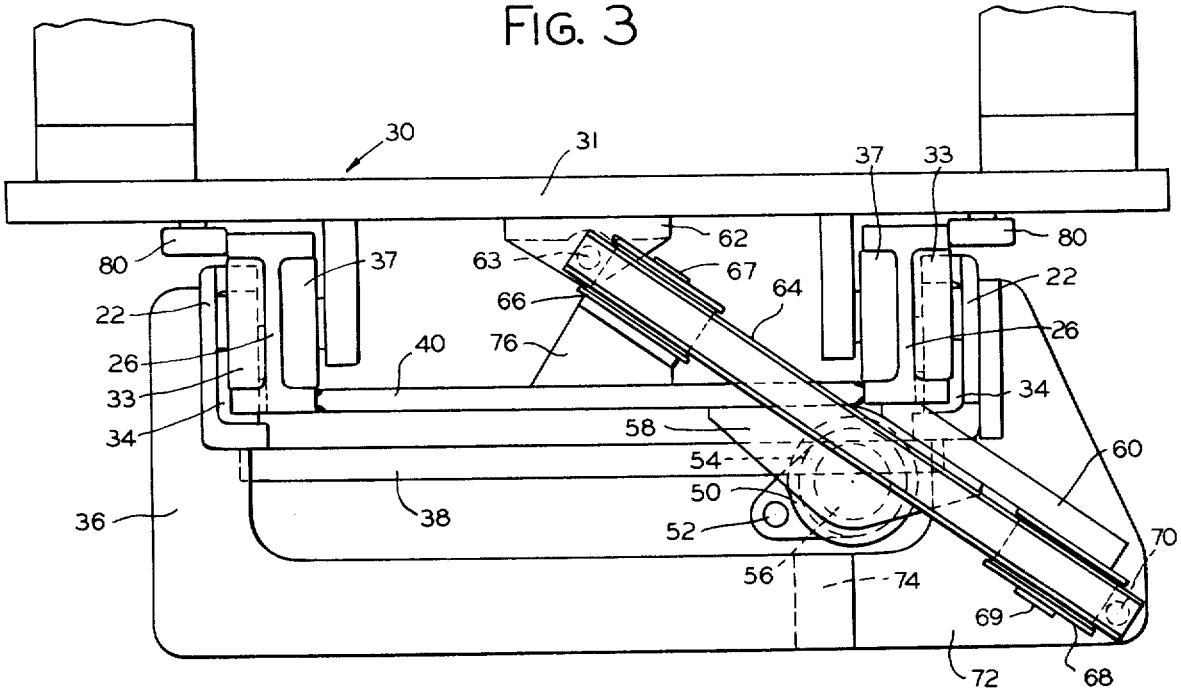
FIG. 3 is an enlarged plan view of the upright shown in FIG. 2.

The I-beam mast section 24 is nested within the outer section 21 in known manner such that the forward flanges of the I-beams 26 are disposed outside of and overlapping the forward flanges of channels 22, and the rear flanges of the I-beams are disposed inside the adjacent channel portions and forwardly of the rear flanges of channels 22, pairs of rollers being suitably mounted between said adjacent pairs of the I-beams and channels for supporting the I-beam telescopic section longitudinally and laterally for extensible movement relative to the fixed channel section. The support and guide rollers of each said pair are illustrated in FIG. 3 at numerals 33 and 34, while the upper rollers mounting the load carriage 30 in the inwardly facing channel portions of the I-beam section are illustrated at 37. Particulars of the nested offset I-beam upright structure, the mounting of the load carriage thereon, and the details of structure and mounting of guide and support roller pairs are explained in detail in U.S. Pat. No. 3,213,967.

As illustrated, a cylinder support block 50 is secured on brace 38 near the right hand side thereof and adjacent and partially behind the one I-beam rail 26, a hydraulic fitting 52 being mounted on the block to communicate pressure fluid to and from a cylinder 54 of a lift cylinder assembly which is mounted on the block for communication with a lift truck hydraulic system, not shown. An extensible piston rod 56 is connected to mast section 24 at the upper end by a bracket 58 which is secured to the piston rod end. Bracket 58 is connected, as by welding, to brace 40 and to a cantilevered support member 60, said member being secured to the rear flange of the adjacent I-beam rail. A chain anchor block 62 is secured centrally of lower fork carrier plate 32 to which is secured at anchor 63 one end of a lifting chain 64, or other flexible lifting means, which extends upwardly and over a pair of spaced sprockets or sheaves 66 and 68, and then downwardly to a fixed anchor connection 70 located in a predetermined position adjacent the outer end of a step-down support and brace plate 72 of brace member 36, the horizontal end portions of brace 36 being connected by a vertical plate 74. Sprocket 66 is mounted for rotation on a stub shaft 67 which is secured in a support block member 76 in turn secured to brace 40. For convenience herein sprocket or sheave (wheel) means may be referred to as "sprocket" or "sprocket means", it being undersood that any suitable wheel means for performing forming a similar function is intended to be included. Sprocket 68 is similarly mounted on a stub shaft 69 on support member 60, the lifting chain and sprockets being mounted on a bias to the upright assembly as is best shown in FIG. 3.

Although I have shown but a single relatively heavy chain 64, it should be understood that in practice it may well be found preferable for safety reasons to use two or more smaller chains reeved in substantially the same manner as is single chain 64 on modified single sprockets or on multiple side-by-side sprockets as desired. Recitations in the claims of "sole flexible lifting means", and the like, include such mutliple side-by-side lifting elements which will perform the same function as does the single lifting element 64 shown in the drawing.

In order to substantially balance the force moments acting in a transverse plane on the embodiment of the upright assembly as disclosed, the connection of the chain to anchor block 62 should be located at or substantially at the transverse center or central vertical plane of carriage 30, and the connection of piston rod 56 to bracket 58 in combination with the location of chain anchor 70 should be such that the piston rod is connected to the bracket at or near one-half the distance between the chain anchor locations as projected in the transverse plane of the upright. Then, the forces passing through upright sections 21 and 24 create substantially no unbalanced moments or a calculated small unbalanced moment in a transverse plane of the upright, as viewed in FIGS. 2 and 3, for example, because the cylinder assembly is centered or approximately centered between the said projected locations of the chain anchors.

As will be understood by persons skilled in the art, in a free body force moment system, neglecting the weight of inner upright section 24, the vertically directed forces acting on the upright in the said projected transverse plane with the piston rod centered as aforesaid comprise a one unit force in an upward direction at each chain end, a one unit force in a downward direction in each vertical run of chain, a two unit force directed upwardly at the center of the piston rod connection to plate 58, and a two unit force directed downwardly at the center of the cylinder on support 50. Thus, the upright functions in theoretical force moment balance. Of course, such theoretical conditions do not normally exist in practice, and side thrusts or torque loading on the upright such as result from unbalanced moments effected by off-center loads on the fork, for example, may be resisted by upper and lower pairs of carriage side thrust rollers 80 operating on the outer flange edges of I-beams 26 in known manner.

Figure 2:
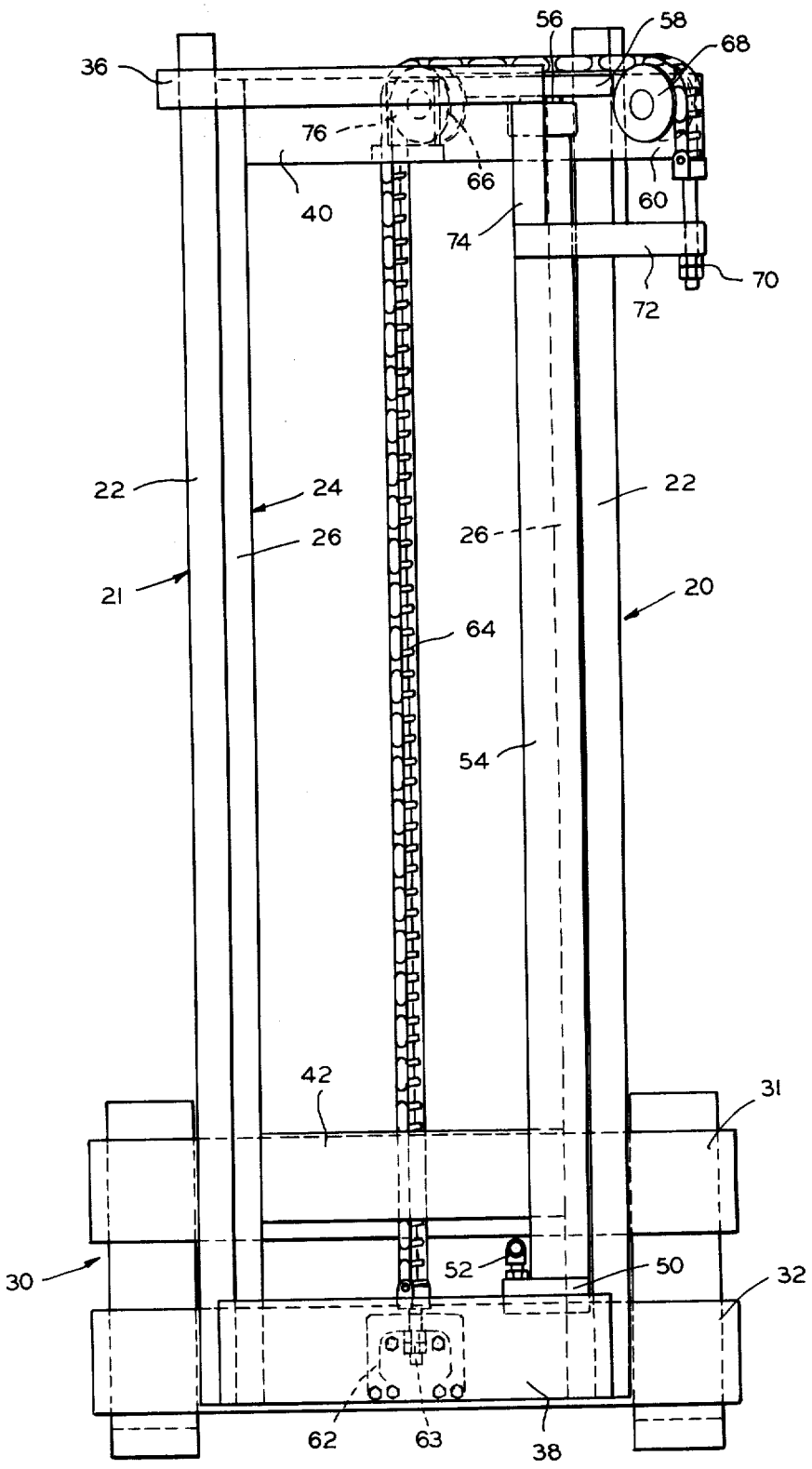
FIG. 2 is an enlarged full rear view of the upright shown in FIG. 1 with the upright dismounted from the truck.

It should be noted that the weight of the inner upright section 24 will impart a slight unbalanced moment in a counter-clockwise direction, as seen in FIG. 2, on a thus centered asymmetric cylinder assembly, so that if desired the latter unbalanced moment may be compensated by adjusting the location of the cylinder assembly slightly inwardly of its said central or midway position between the projected chain anchor locations. On the other hand any such inward adjustment of the cylinder assembly location may tend to interfere with maximum visibility through that side of the upright, depending upon the operator's normal location on the truck. Also, any such unbalanced force moments are relatively minor and should, in most upright designs, be readily acceptable in the overall design, which usually includes some provision for resisting side thrust such as by rollers 80.

The designer of uprights of various widths, depths, seat locations, and the like may choose any one of a number of viable combinations of such structure within the scope of my invention. It should therefore be understood that recitations in the claims hereof relating to the substantial or approximate balance of force moments in the upright, or to the asymmetric position of the cylinder substantially or approximately centered between the projected chain anchor locations or the like, shall be interpreted to include a range of positions of the cylinder assembly between the sprockets which best effects the desired result of good operator visibility through the upright and adequately balanced force moments acting on the upright in operation.

The design is such that the location of the cylinder assembly at one side of the upright combines with the location of the operator, preferably offset a predetermined distance to the opposite side of the longitudinal axis of the truck, to provide an operator's line of sight through the upright on the side at which the cylinder assembly is located so that the cylinder assembly interferes a relatively small amount or not at all with the operator's visibility through that side of the upright. In other words, the cylinder assembly projects at least partially into the area of interference by the adjacent side of the upright when in a retracted or collapsed position with the visibility of the operator from his normal line of sight through that side of the upright.

The principles of the upright design as described hereinabove may be applied to many and various types and designs of multiple stage uprights, including, without limitation, free-lift and triple stage uprights as described later herein.

References made in the specification and claims hereof to the longitudinal plane of one side of the upright, or of a transverse plane of the upright, or terms of similar import, shall have the following meanings:

The longitudinal plane of the one side of the upright shall mean a three-dimensional vertical plane extending longitudinally of the upright assembly bounded by the outer and inner surfaces of the vertical rail assembly on one side of the upright, while the transverse plane of the upright or of the one side thereof shall mean any two-dimensional vertical plane extending transversely of the upright assembly in the area bounded by the front and rear surfaces of the vertical rail assemblies of the upright comprising the assembled upright sections.

Figure 5:
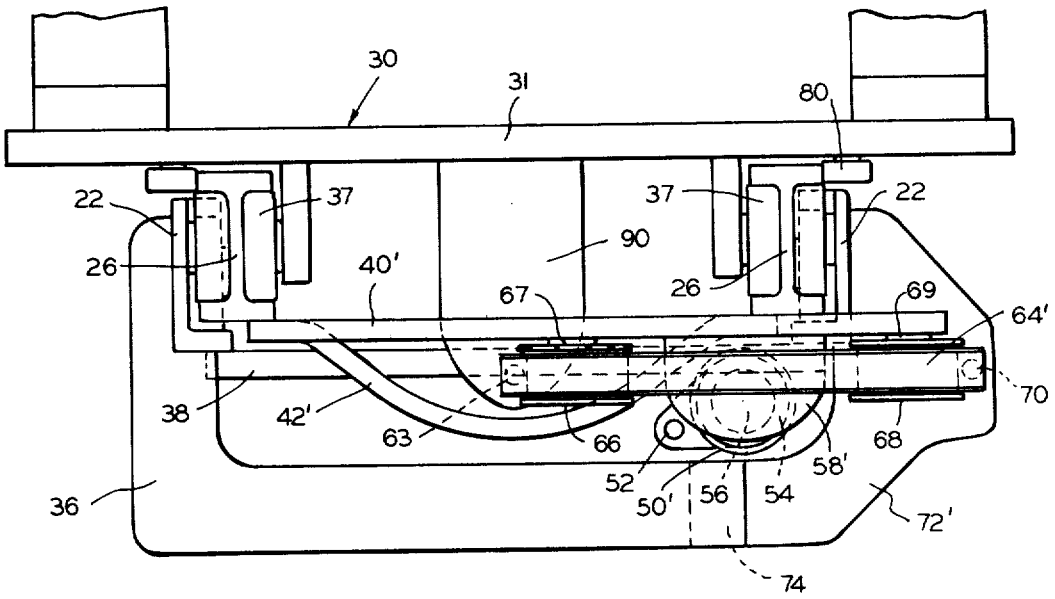
FIG. 5 is a plan view of the upright which shows a modification of the structure shown in FIG. 3.
Figure 6:
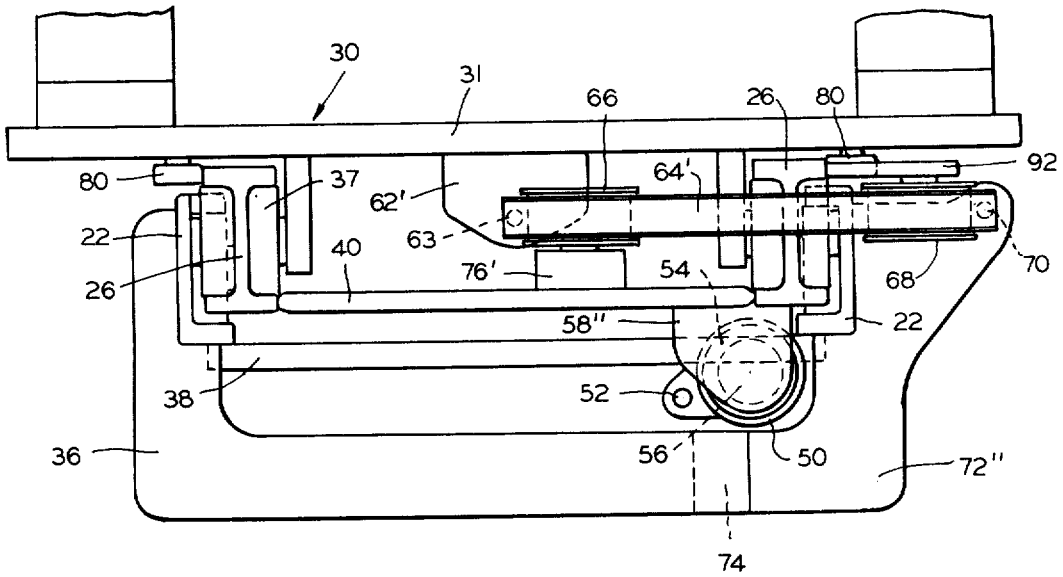
FIG. 6 is a plan view of the upright which shows another modification of the structure shown in FIG. 3.
Figure 7:
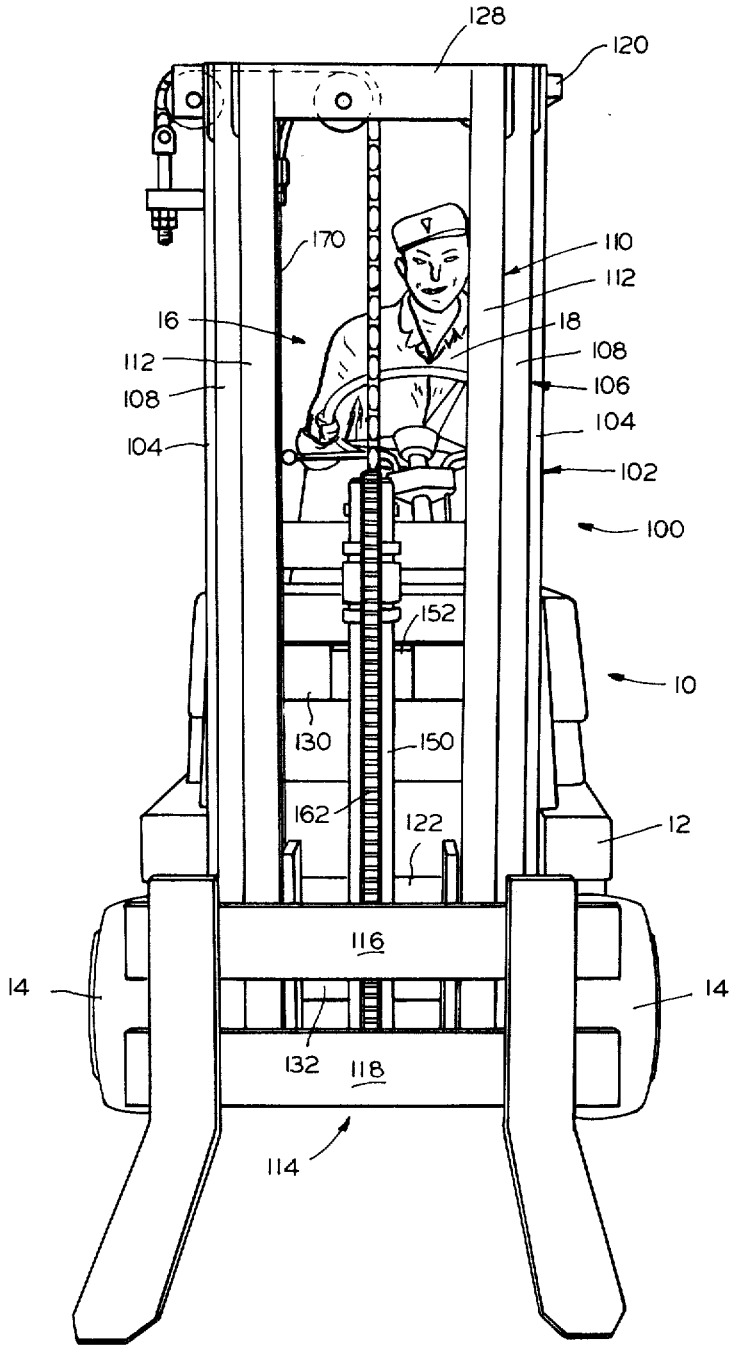
FIG. 7 is a view similar to FIG. 1 showing a triple stage upright construction.

Referring now to the modifications shown in FIGS. 5 and 6, I have shown exemplary modified structure wherein some of the parts are or may be the same as in FIG. 3, and these parts have been numbered the same as in FIG. 3. Exemplary similar but modified parts are identified by the same numeral as in FIG. 3, but carry a single or double prime designation, as, for example, element 72,72' and 72" as between FIGS. 3, 5 and 6 respectively. Wholly new parts are identified by new numbers. For example, a long cantilevered new anchor block is identified by numeral 90 in FIG. 5, but by numeral 62' in FIG. 6 in which, in combination with support block 76' for mounting sprocket 66, the latter parts represent basically merely a difference in configuration when compared with the similar parts 62 and 76 in FIG. 3.

Referring now in detail to FIG. 5, the modified structure comprises mainly a relocation of sprockets 66 and 68 so that they are mounted in transverse relationship to the upright which effects incidentally a shortening of the chain as shown at 64'. In order to accomplish this mounting arrangement while maintaining the lift cylinder assembly 54,56 in a similar adjacent relationship to the right hand side of the upright, the cylinder assembly is located somewhat longitudinally rearwardly of the position shown in FIG. 3 out of any transverse plane of the adjacent one side of the upright. The cylinder assembly is thus located by securing it between cylinder support block 50' and bracket 58', the latter being secured, as by welding, to the rear side of upper brace 40' of inner mast section 24 which is secured to the rear faces of the rear flanges of I-beams 26 and which extends outwardly of the right side of the upright as seen in FIG. 5 for supporting thereon adjacent the outer end the sprocket 68, as shown. Sprocket 66 is aligned for rotation with sprocket 68 transversely of the upright, it being mounted also from the rear surface of brace 40', lifting chain 64' being reeved on the sprockets and secured at its one end at anchor 70 to step-down support plate 72' of modified configuration and secured at its opposite end at anchor 63 to an elongated cantilevered chain anchor support 90 which is secured from the rear of lower fork carriage plate 32, the same as is anchor block 62 in FIGS. 1-4. Sprockets 66 and 68 are cantilever supported from brace 40' in this embodiment by the stub shafts 67 and 69. The lower brace member 42' secured between I-beams 26 is of a bowed configuration as shown in order that anchor support member 90 may clear brace 42' during movements of the fork carriage near the lower end of the I-beam upright section. The mounting relationship between support block 90 and a lower brace 38 of outer section 21 is, of course, such that there is no interference between the support block and brace when the fork carriage is at its lowermost position in the upright.

Referring to FIG. 6, a modified construction is shown wherein provision is made for sprockets 66 and 68 to be mounted in aligned transverse relationship of the upright in a forward location relative to the location thereof shown in FIG. 5. In this construction a location of the lift cylinder assembly in relation to the adjacent one side of the upright may be provided, as shown, which is approximately the same relative location as shown in FIGS. 1-4. Thus, the transverse upright braces 36, 38, 40 and 42 may be the same as in FIGS. 1-4, as shown, except that the configuration of the step-down portion 72" of brace 36 is altered to provide a suitable location for anchor 70, the cylinder assembly being mounted from support block 50 and secured at the upper end to bracket 58".

As mentioned above sprocket 66 is supported from block member 76' and the chain is secured at anchor 63 to anchor block 62', similarly as in FIGS. 1-4 except as modified to provide for a transverse aligned relationship between the sprockets. Sprocket 68 is mounted from a cantilevered support plate 92 which is secured at its inner end to the outer surface of the forward flange of the one I-beam 26 and above the upper side thrust rollers 80.

In the operation of the various embodiments of FIGS. 1-6 pressurized fluid is conducted to or exhausted from the single-acting lift cylinder asssembly 54,56 which effects a simultaneous elevation or lowering, as the case may be, of fork carriage 30 in telescopic upright section 24, and of the latter upright section in fixed section 21 without free-lift of the load carriage in relation to upright section 24 during elevation. The load carriage is elevated at a 2:1 ratio in relation to section 24 from the position shown in FIGS. 1 and 2 to that shown in FIG. 4, section 24 being elevated with the piston rod in relation to outer section 21.

Referring now to FIGS. 7–12, similar parts of the truck chassis and body are numbered the same as in FIG. 1.

The triple stage upright assembly shown at numeral 100 comprises a fixed mast section 102 which includes a pair of transversely spaced opposed channel members 104 arranged to receive an intermediate telescopic mast section 106 formed of two laterally spaced I-beams 108, mast section 106 being guide roller supported in mast section 102 and arranged for longitudinal movement relative thereto. An inner mast section 110 formed of two laterally spaced I-beams 112 is similarly guide roller supported in mast section 106 and arranged for longitudinal movement relative thereto. A load or fork carriage 114 having a pair of transverse support plates 116 and 118 is guide roller mounted for elevation in the inner upright section 110, all in known manner.

Mast section 102 is cross-braced for rigidity by means of upper and lower transverse brace members 120 and 122, intermediate telescopic section 106 is cross-braced by upper and lower transverse members 124 and 126, and inner section 110 is cross-braced by upper, intermediate and lower transverse members 128, 130, 132, and 134, members 130 and 132 also serving to support the primary lift cylinder, as will be explained.

Figure 9:
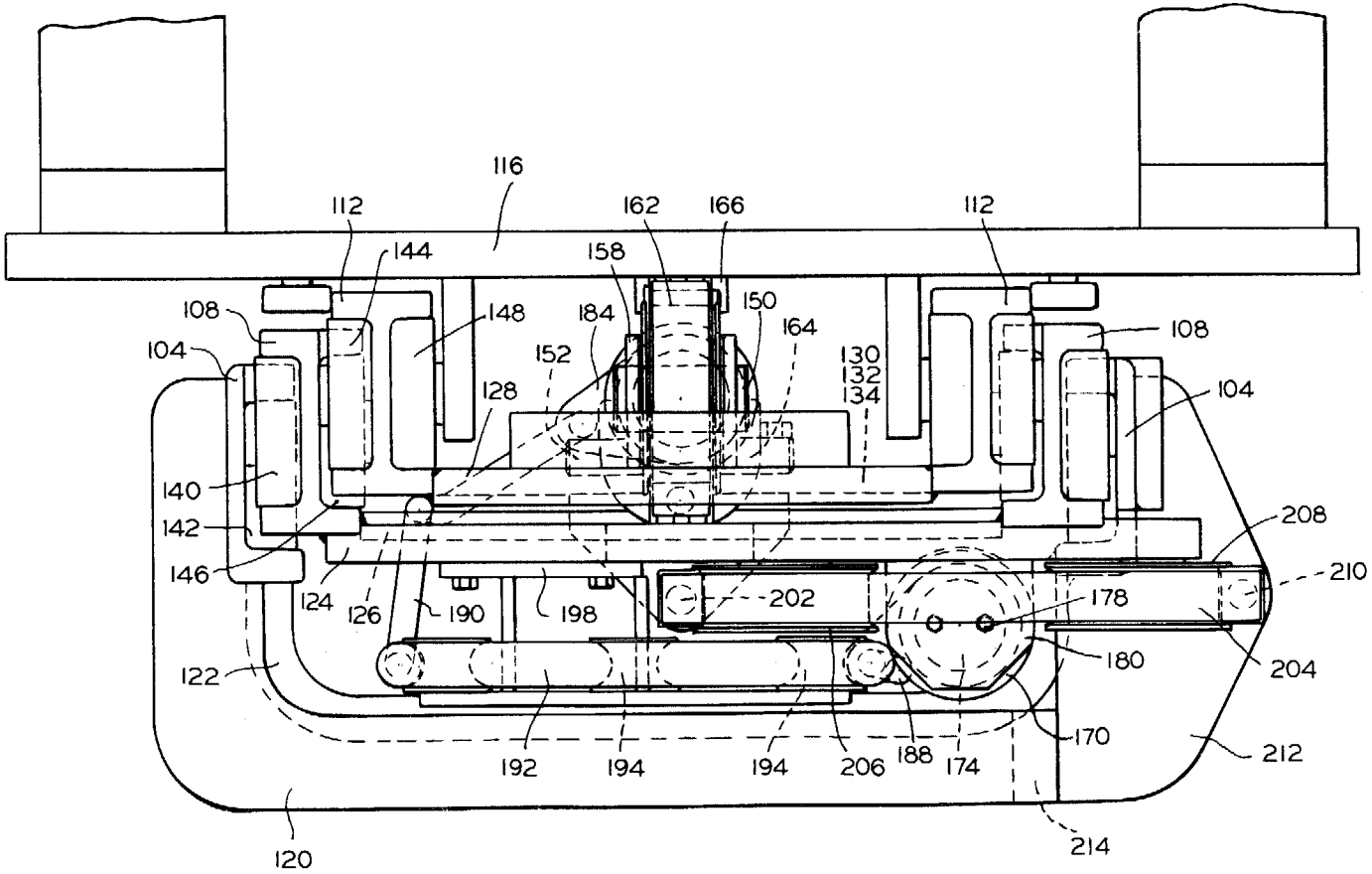
FIG. 9 is an enlarged plan view of the upright shown in FIG. 8.

The I-beam mast section 106 is nested within the outer section 102 in known manner such that the forward flanges of the I-beams 108 are disposed outside of and overlapping the forward flanges of channels 104, and the rear flanges of the I-beams are disposed inside the adjacent channel portions and forwardly of the rear flanges of channels 104, pairs of rollers being suitably mounted between said adjacent pairs of the I-beams and channels for supporting the I-beam telescopic section longitudinally and laterally for extensible movement relative to the fixed channel section. In a similar manner, inner I-beam mast section 110 is nested within intermediate section 106 for extensible movement relative to the intermediate I-beam section. The support and guide rollers of each said pair are illustrated in FIG. 9 at 140, 142 and 144, 146, while the upper rollers mounting the load carriage 114 in the inwardly facing channel portions of the inner I-beam section are illustrated in FIG. 9 at 148. Certain particularities of the triple-stage nested offset I-beam upright structure, the mounting of the load carriage thereon, and the details of structure and mounting of guide and support roller pairs are explained in detail in U.S. Pat. No. 3,213,967.

Figure 10:
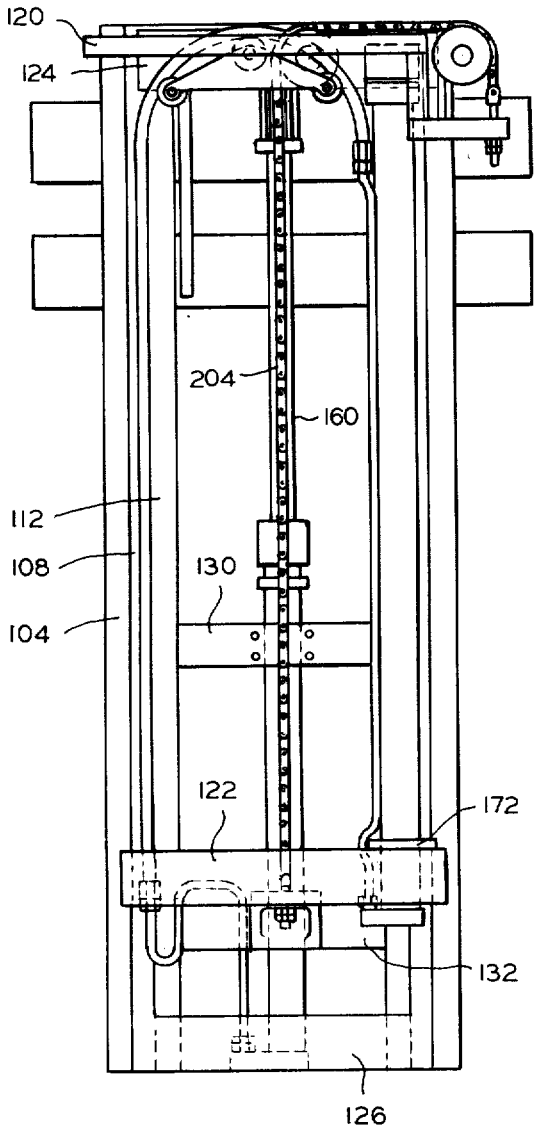
FIG. 10 is a somewhat schematized rear view in reduced scale of the upright shown in FIG. 2 wherein the load carriage is elevated by a primary cylinder to a full free-lift position.
Figure 11:
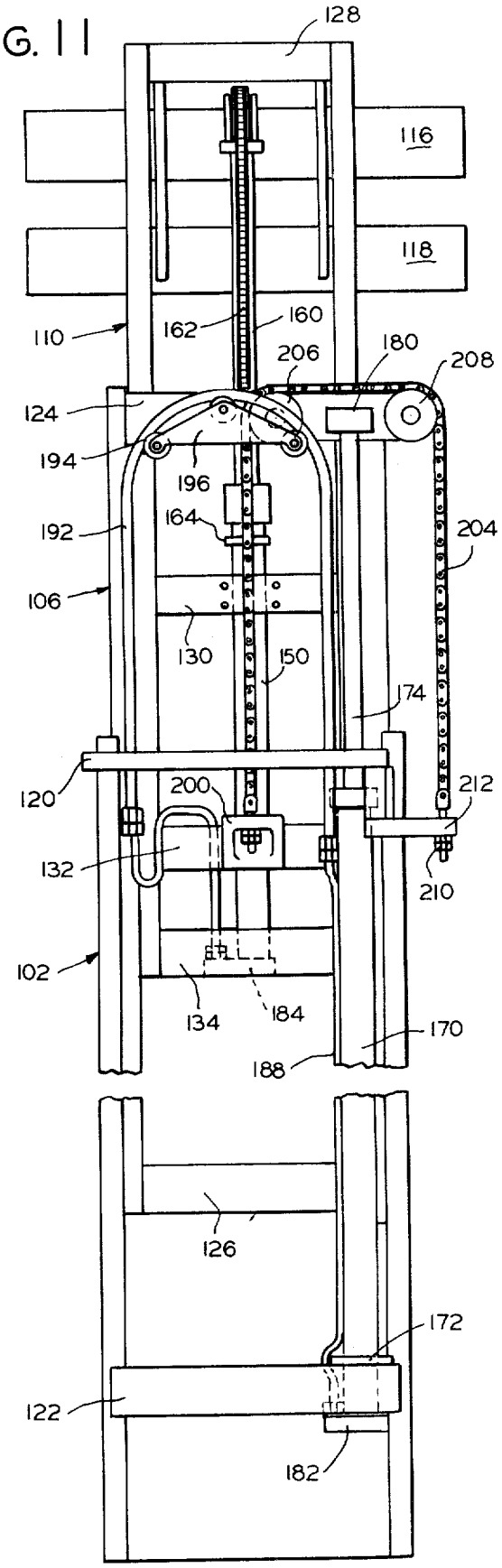
FIG. 11 is a somewhat schematized rear view of the upright at partial elevation.
Figure 12:
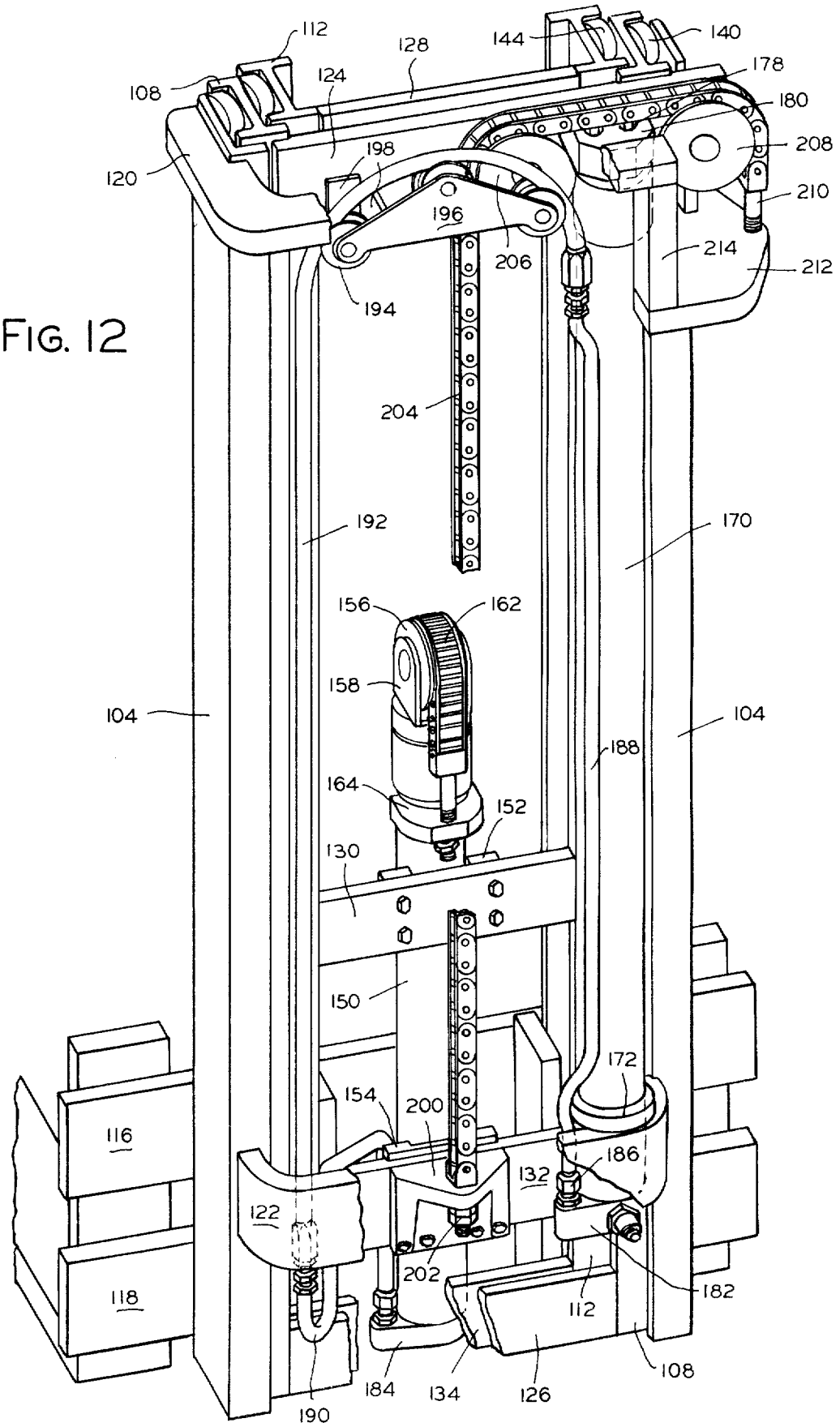
FIG. 12 is a partially cut-away rear perspective view of the upright with the load carriage at floor level.

A primary cantilevered lift cylinder assembly 150 is supported centrally of inner upright section 110 on brace members 130 and 132 by brackets 152 and 154 secured, as by welding to the cylinder and secured by studs to the transverse brackets 130 and 132 (FIG. 12). A single sprocket 156 is mounted for rotation by a bracket 158 at the end of a piston rod 160, a lifting chain 162 being reeved on the sprocket and secured at one end to an anchor plate 164 located on the cylinder, and at the opposite end secured centrally of carriage plate 118 by an anchor block 166 (FIG. 9). The hydraulic lift cylinder 150 is substantially one-half the length of the inner upright section and when extended actuates the fork carriage at a 2:1 ratio to a full free-lift position as shown in FIG. 10 prior to the elevation of intermediate and inner upright sections 106 and 110 by a secondary asymmetric hydraulic lift cylinder assembly 170, shown in a position of partial extension in FIG. 11.

The cylinder 170 is supported near the bottom from brace member 122 by a collar 172 welded to the cylinder and to the top edge of the brace member, the piston rod 174 being secured by a pair of studs 178 to a block member 180 which is welded to the rear surface of brace member 124, thus supporting the cylinder assembly from the top and bottom portions. A junction block 182 is located at the bottom of the cylinder for conveying pressure fluid to and from the cylinder from a hydraulic system, not shown, it being also connected to a junction block 184 of the primary cylinder by a fitting 186 in block 182, non-flexible conduits 188 and 190, and a flexible conduit 192 which connects conduits 188 and 190 and which is reeved on three sheaves 194 mounted for rotation in a bracket 196 which is supported from brace member 124 by a bracket 198. The sheaves and conduit assembly are mounted in an inverted U-shaped position behind or adjacent certain upright rails so that interference thereof with visibility of the operator is minimized.

A chain anchor block 200 is secured centrally of inner upright transverse brace member 132 at an anchor connection 202 of a secondary lifting chain 204 which extends upwardly and over a pair of spaced sprockets 206 and 208, and then downwardly to a fixed anchor connection 210 located in a predetermined position adjacent the outer end of a step-down support and brace plate 212 of brace member 120, the horizontal end portions of brace 120 being connected by a vertical bar 214. The sprockets are mounted for rotation as in the two-stage upright on stub shafts which are cantilever mounted in and secured to transverse brace member 124.

The force moments acting on the upright assembly are, of course, balanced in respect of the operation of centered primary cylinder 150, and in respct of operation of asymmetric cylinder 170,174 operating centrally or approximately centrally between the sprockets and having the inner end of chain 204 connected substantially centrally of the inner upright. The forces passing through the respective upright sections create substantially no unbalanced moments, or create a calculated unbalanced moment in a transverse plane of the upright in a manner similar to that described in detail above in respect of the two-stage upright.

The structure and operation of the triple stage upright as disclosed will now be apparent, particularly when taken in conjunction with the more detailed description of the principles of my invention and of some of the available design variations thereof described above in connection with the two-stage upright. I have found that in order to achieve most desirable results in terms of operator visibility, that cylinder 170 should be located such that it projects a distance into the aforementioned area of interference by the adjacent side of the retracted upright which is equal to or greater than the radius of the cylinder.

Figure 8:
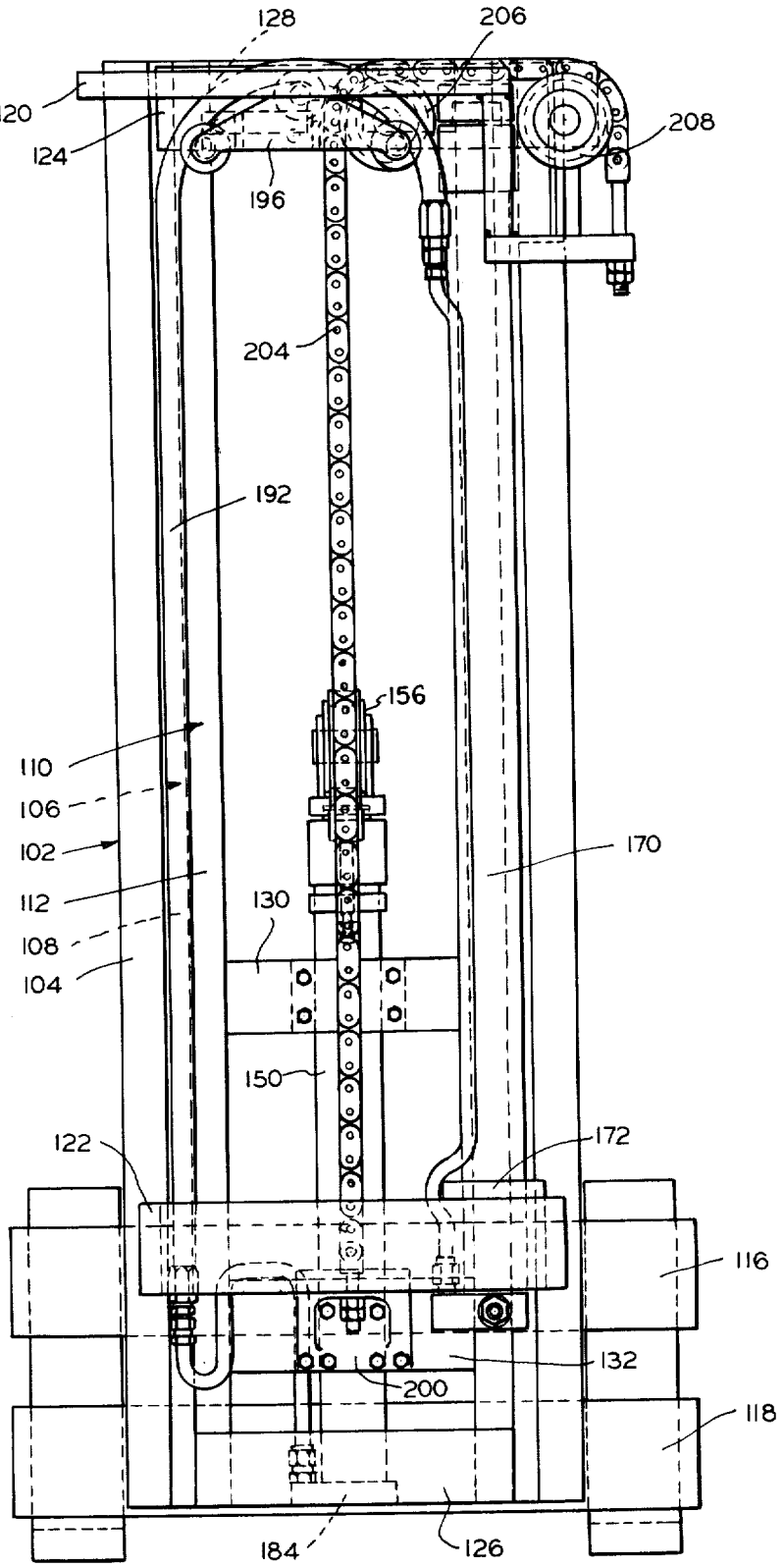
FIG. 8 is an enlarged full rear view of the upright shown in FIG. 7 with the upright dismounted from the truck.

In operation to elevate the upright from the position in FIG. 8 to that in FIG. 11, for example, pressure fluid is delivered by the hydraulic system simultaneously to cylinder assemblies 150 and 170 and, as is known, the cylinders operate automatically in a sequence related to the loads supported thereby, whereby cylinder 150 functions initially to elevate load carriage 114 in inner upright section 110 to the full free-lift position illustrated in FIG. 10 at 2:1 ratio to the movement of piston rod 160. At the termination of this initial stage of operation the pressure fluid automatically sequences asymmetric cylinder 170 to elevate the entire telescopic upright structure in outer section 102 while the load carriage is maintained by primary cylinder 150 in the aforementioned full free-lift position; i.e., the direct connection of cylinder assembly 170 to intermediate section 106 effects an elevation thereof in section 102, as shown in partial elevation in FIG. 11, and simultaneously effects through the reeving and connection of chain 204 to inner upright section 110 an elevation thereof at a 2:1 movement ratio relative to section 106 to the position shown in FIG. 11, and thence to a position of maximum elevation if the operator maintains the supply of pressure fluid from the hydraulic system. Lowering of the upright is effected by venting the cylinders to the fluid reservoir, whereby a reversal of the above-mentioned sequencing occurs as cylinder assembly 170 first fully retracts to the position of FIG. 10, subsequent to which cylinder 150 retracts the load carrier to the FIG. 8 position.

Figure 4:
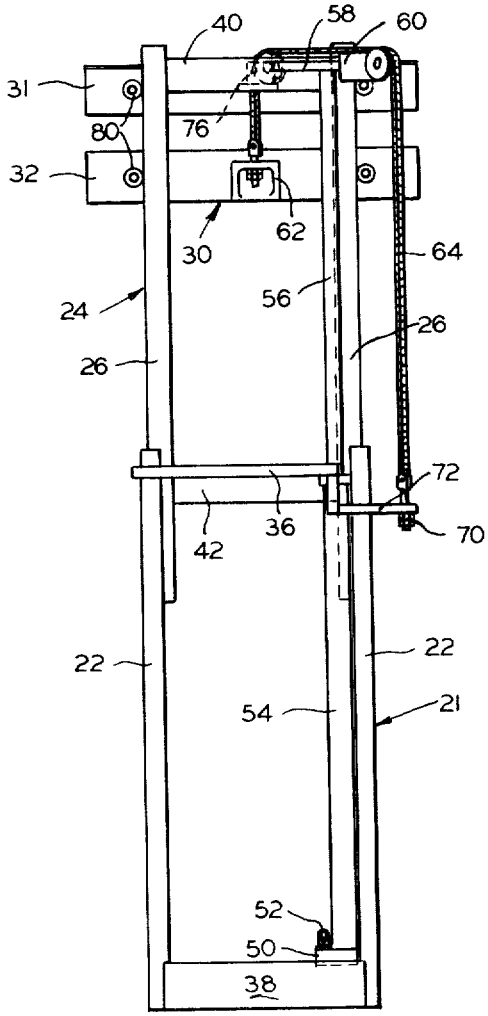
FIG. 4 is a somewhat schematized rear view reduced in scale and shown extended to full elevation.
Figure 13:
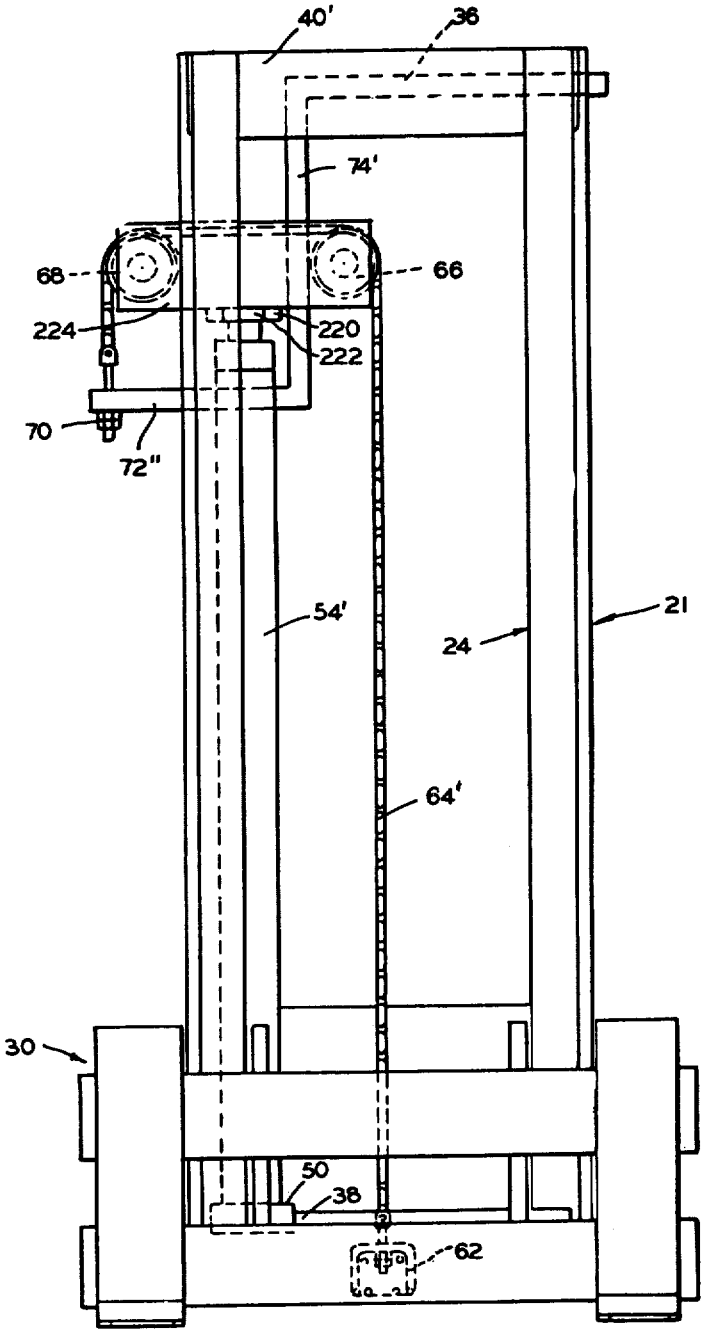
FIG. 13 is a front view of a modification of the upright shown in FIG. 2.
Figure 16:
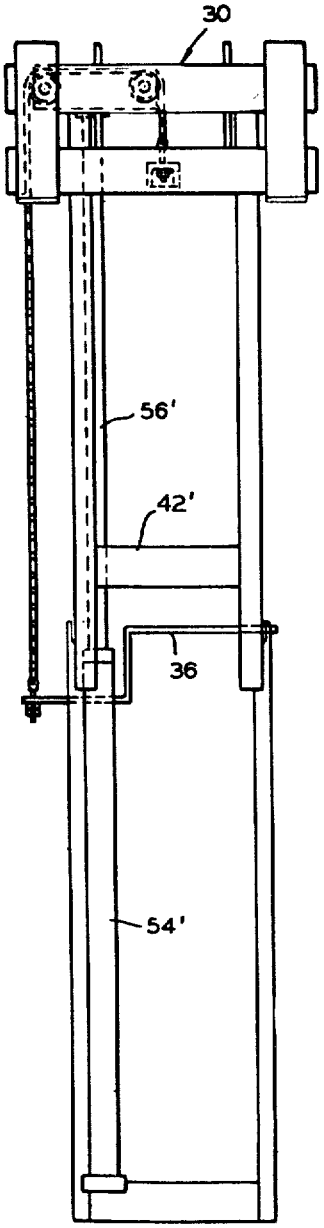
FIG. 16 is a somewhat schematized front view of the upright of FIG. 13 reduced in scale and shown extended to full elevation.
Figure 14:
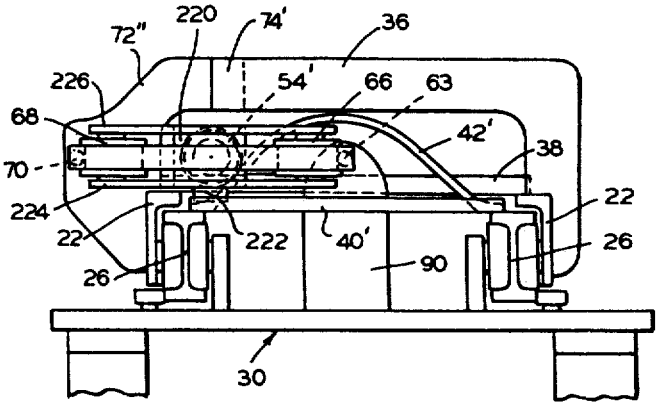
FIG. 14 is a plan view of the upright of FIG. 13.
Figure 17:
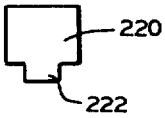
FIG. 17 is a detail view of a part of the piston rod construction of the lift cylinder.
Figure 15:
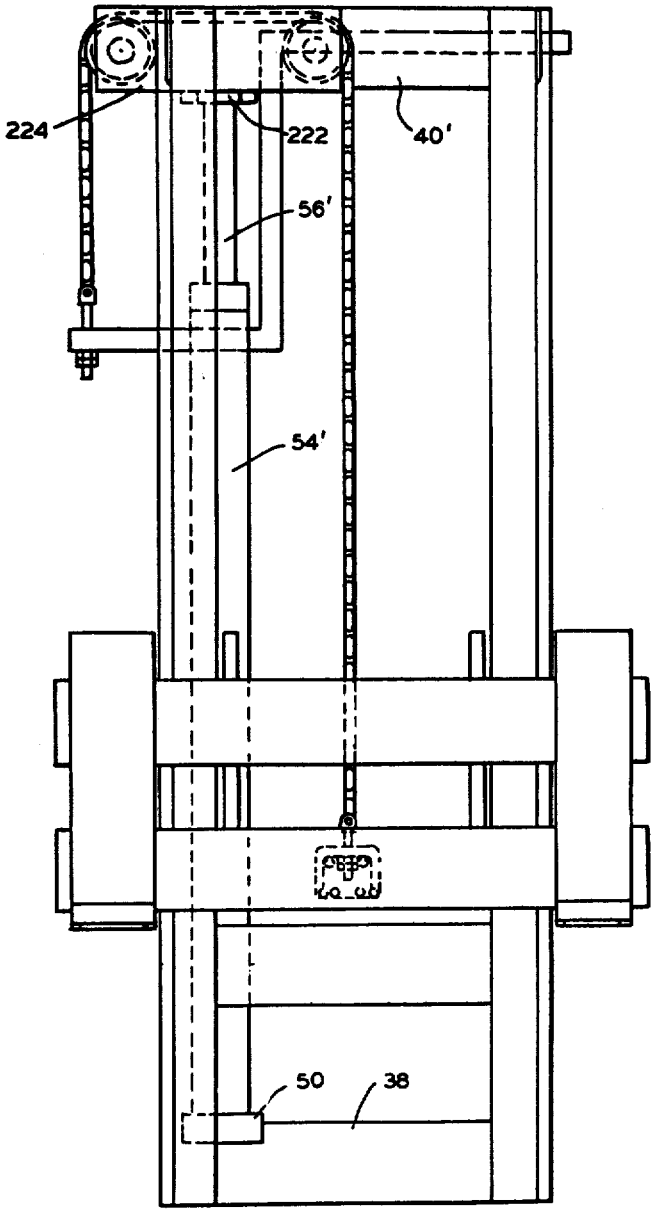
FIG. 15 is a view of the upright of FIG. 13 showing the fork carriage in a free-lift position.

Referring now to the modified two-stage upright assembly of FIGS. 13–17, major similar parts have been numbered the same as in FIGS. 2, 4, and 5, the upright shown being basically in accordance with the modification of FIG. 5 in respect of the mounting of the sprockets in transverse relation to the upright, except that the sprockets are mounted not on upper brace 40' of inner mast section 24 but on the upper end of the piston rod of the cylinder assembly so as to provide standard free-lift capability of the fork carriage as shown in FIG. 15, as is well known. Except for the design variation which provides such free-lift, the upright assembly of FIGS. 13–17 is similar to the design as shown in FIGS. 2, 4, and 5. It will be appreciated, of course, that reference to FIGS. 2 and 4 construction assumes a FIG. 5 type modification thereto. The use of single or double prime designations follows the same usage as in FIGS. 5 and 6 as defined above.

The cylinder assembly 54', 56' is mounted rigidly from the base at 50 on brace 38 and is of a shorter length than in FIGS. 2, 4, and 5, as shown, so as to enable the load carriage 30 to be actuated in the upright to a free-lift position, as shown in FIG. 15, as piston rod 56' extends from the position in FIG. 13 to that in FIG. 15. Mounted rigidly atop the piston rod is a block or plate member 220 (FIG. 17) having a projection 222 which extends forwardly so as to make contact with brace 40', FIGS. 14 and 15, in order to actuate inner upright section 24 to the FIG. 16 position as carriage 30 is elevated from the FIG. 15 to the FIG. 16 position by chain 64', as the piston is extended from the FIG. 15 to the FIG. 16 position. Sprockets 66 and 68 are mounted on shafts at the opposite ends of a pair of longitudinally spaced support plate members 224 and 226 which extend transversely of the upright and are mounted rigidly, as by welding, on the top of plate 220, the projection 222 extending forwardly as shown in FIG. 14. The piston rod is connected to the sprocket assembly at or near one-half the distance between the chain anchor locations 63 and 70 in this modified upright design wherein its sprockets are aligned for rotation transversely of the upright the same as in FIG. 5. The upper brace 36 has a deeper step-down portion 72'' connected by member 74' than is present in FIGS. 4 and 5 so that the free-lift structure may be effected; i.e., so that a shorter cylinder assembly with predetermined free-lift and lower maximum fork height in an equal length upright is made available.

It will be understood by persons skilled in the art that many other design variations in the upright designs than those identified and described previously may be found feasible without departing from the scope of my invention.

For example, although the basic design of the upright disclosed in all embodiments herein as being of the offset I-beam roller mounted design is preferred because of the space provided behind the rear flange or flanges of the I-beam vertical rails for partial nesting of the asymmetric cylinder therein, as seen best in FIGS. 3, 6 and 9, it will be appreciated that the invention may be also used with many other known upright designs, including coplanar (not offset) roller mounted channels or I-beams, fully nested roller mounted I-beams inside of outer channels, non-roller mounted sliding inner channel in outer channel, a telescopic upright section mounted outwardly of an inner mounted fixed upright section, and the like.

The location of the fixed chain anchors 70 and 210 may, of course, be varied in different upright designs as desired, such as at different selected vertical locations on the outer rail, or located on a cantilevered anchor support which may be secured to the asymmetric cylinder, or in the case of an upright mounted from certain types of lift trucks without provision for fore and aft tilting thereof, the anchor can be located on the truck frame. In the latter design it may be feasible, of course, to mount the bottom of the asymmetric cylinder assembly also from the truck frame instead of directly from the bottom of the fixed upright section.

It may be found advantageous in some designs to mount the asymmetric cylinder assembly so that the cylinder 54 or 170 elevates on a fixed piston rod 56 or 174, in kown manner; i.e., by reversing the position of the assemblies as shown, and utilizing the piston rod also as a pressure fluid conduit to the cylinder to be actuated.

Depending upon such things as the axial distance of the operator from the upright, the width of the upright, or the transverse position of the operator when seated or standing in a normal operating position on different lift truck types, the most desirable precise location of the asymmetric cylinder assembly based upon the various factors will be established, many of the major ones of which are discussed above. As noted previously the most critical combination of factors affecting the selection of a cylinder location is operator visibility and force moment balance on the upright, both of which may be compromised from the ideal within the scope of my invention as required to effect the most desirable combination. In this connection it will be understood that the asymmetric cylinder assembly may in different sizes and designs of uprights desirably project partially into both the longitudinal and transverse planes of the one side of the upright, as best seen in FIGS. 3, 6, and 9.

In a relatively wide upright, for example, and with the operator located relatively close to the upright in a forward direction and well off-center to the left thereof, it may be found advantageous to locate the cylinder further forwardly than is shown in FIG. 3, for example, necessitating a relocation thereof leftwardly and out of the longitudinal plane of the right side of the upright, in which event the cylinder would project partially into only the transverse plane of the upright without interfering unduly with operator visibility through the upright. On the other hand, it may be found under certain design conditions that the cylinder may be located further rearwardly so as to project into the longitudinal plane only, partially or even wholly, of the one side of the upright, and not project at all into the transverse plane thereof, as in FIG. 5. Again, it may be found desirable that the cylinder project into neither such plane, all within the scope of my invention.

However, before the particulars of any given upright design are finalized, it is important to understand that in any multi-section upright using this invention, whether of two, three, or more stages, and regardless of other available numerous design variations such as are described herein, the asymmetric cylinder assembly should be located such that it projects at least partially, and preferably substantially, into the area of interference by the adjacent side of the upright when in a retracted or collapsed position with the visibility of the operator from his normal line of sight through that side of the upright. A normal line of sight may be defined as comprising the operator's line of sight when located in a predetermined designed position and attitude for normal operation of a lift truck. Preferably the distance of cylinder projection into said area of interference should be equal at least to the radius of the cylinder, although this may not be achievable in certain standard or two stage upright designs, for example.

Although I have illustrated only certain embodiments of my invention, it will be understood by those skilled in the art that many modifications, such as are discussed above, may be made in the structure, form, and relative arrangement of parts without departing from the spirit and scope of the invention. Accordingly, I intend to cover by the appended claims all such modifications which properly fall within the scope of my invention.

I claim:

1. In a upright structure for lift trucks and the like having one upright section including transversely spaced vertical rails, a telescopic upright section including transversely spaced vertical rails mounted for elevation relative to said one section and elevatable load carrier means mounted for elevation relative to said telescopic section, the improvement comprising a sole asymmetric lift cylinder assembly mounted in the upright structure which is operatively connected to said telescopic upright section, elongated flexible lifting means operatively connected to said cylinder assembly, to said one upright section and to said load carrier means and having one end means thereof secured a substantial distance outwardly of one side only of the cylinder assembly in a direction which includes a lateral component and having the other end means thereof secured to said load carrier means, said cylinder assembly together with said flexible lifting means being adapted to elevate said load carrier means relative to the telescopic upright section and the latter section relative to the one upright section, the lift cylinder being located a substantial distance toward one lateral side of the upright structure such that it projects at least partially into the area of interference by an adjacent vertical rail with the visibility of the operator from his normal line of sight through said adjacent vertical rail, said normal line of sight being defined when the operator is located in a predetermined designed position and attitude for normal operation of the lift truck, the operative connection of said cylinder assembly to said telescopic section in relation to said one and other end means being such that at least approximately balanced lifting force moments act upon the upright structure in the transverse plane of the upright at least when a load is carried substantially centrally thereof.

2. An upright structure as claimed in claim 1 wherein said cylinder assembly projects into at least a portion of the longitudinal plane of an adjacent vertical rail on the said one side of the upright structure.

3. In an upright structure for lift trucks and the like having one upright section including transversely spaced vertical rails, a first telescopic upright section including transversely spaced vertical rails mounted for elevation relative to said one section, a second telescopic upright section including transversely spaced vertical rails mounted for elevation relative to said first telescopic upright section, and a load carrier means mounted for elevation relative to said second telescopic upright section, the improvement comprising a sole asymmetric lift cylinder assembly mounted in the upright structure which is operatively connected to said first telescopic upright section, elongated flexible lifting means operatively connected to said cylinder assembly, to said one upright section and to said second telescopic section and having one end means thereof secured a substantial distance outwardly of one side only of the cylinder assembly in a direction which includes a lateral component and having the other end means thereof secured to said second telescopic section, said cylinder assembly together with said flexible lifting means being adapted to elevate said second telescopic section relative to the first telescopic section and the latter section relative to the one upright section, the lift cylinder being located a substantial distance toward one lateral side of the upright structure such that it projects at least partially into the area of interference by an adjacent vertical rail with the visibility of the operator from his normal line of sight through said adjacent vertical rail, said normal line of sight being defined when the operator is located in a predetermined designed position and attitude for normal operation of the lift truck, the operative connection of said cylinder assembly to said first telescopic section in relation to said one and other end means being such that at least approximately balanced lifting force moments act upon the upright structure in the transverse plane of the upright at least when a load is carried substantially centrally thereof.

4. An upright structure as claimed in claims 1 or 3 wherein said cylinder assembly is mounted at least partially rearwardly of the adjacent vertical rail assembly and projects at least partially into the transverse plane thereof.

5. An upright structure as claimed in claims 1 or 3 wherein the location of said lift cylinder is such that it projects substantially into said area of interference by an adjacent vertical rail.

6. An upright structure as claimed in claims 1 or 3 wherein the location of said lift cylinder is such that it projects a distance into said area of interference by an adjacent vertical rail which is at least equal to the radius of the cylinder.

7. An upright structure as claimed in claims 1 or 3 wherein the location of said lift cylinder is such that it projects a distance into said area of interference by an adjacent vertical rail which is greater than the radius of said cylinder.

8. An upright structure as claimed in claim 1 wherein said cylinder assembly is supported primarily from the vertical rail of one side of said one upright section.

9. An upright structure as claimed in claim 3 wherein a second lift cylinder assembly is adapted to elevate said load carrier means relative to said second telescopic section, and inverted U-shaped conduit means connecting hydraulically the base ends of the asymmetric and second lift cylinder assemblies, said conduit means cylinder assembly being connected also to said telescopic upright section and a cantilevered support member supported from the telescopic section on which is mounted one of said wheel elements.

26. An upright structure as claimed in claim 21 wherein said cylinder assembly is connected at least approximately centrally of the projected said one and other end means of said flexible lifting means.

27. An upright structure as claimed in claim 21 wherein said first and second wheel elements are aligned in biased relation to the upright structure.

28. An upright structure as claimed in claim 21 wherein said first wheel element is mounted intermediate the spaced vertical rails and said second wheel element is mounted adjacent to one side of the upright structure.

29. An upright structure as claimed in claim 28 wherein said first wheel element is mounted at least partially in the transverse plane of the upright structure.

30. An upright structure as claimed in claim 28 wherein said first and second wheel elements are mounted outside of the transverse plane of the upright structure.

31. An upright structure as claimed in claim 21 wherein said cylinder assembly projects into the vertical plane of said first and second wheel elements.

32. An upright structure as claimed in claim 31 wherein said first wheel element is mounted intermediate the longitudinal planes of the said spaced vertical rails and said second wheel element is mounted adjacent to one side of the upright structure.

33. An upright structure as claimed in claim 32 wherein the sole substantial interference with operator visibility through that portion of the upright structure which comprises said cylinder assembly and telescopic section is a single run of said flexible lifting means when the load carrier means is lowered.

34. An upright structure as claimed in claim 32 wherein said cylinder assembly projects into at least a portion of the longitudinal plane of said adjacent vertical rail on said one side of the upright structure.

35. An upright structure as claimed in claim 21 wherein said flexible lifting means comprises sole lifting chain means in the upright, and said cylinder assembly is the sole such assembly in the upright, said upright being a two-stage upright structure and said load carrier means being a load handling carriage adapted to carry fork tines.

36. In an upright structure for lift trucks and the like having one upright section including transversely spaced vertical rails, a first telescopic upright section including transversely spaced vertical rails mounted for elevation relative to said one section, a second telescopic upright section including transversely spaced vertical rails mounted for elevation relative to said first telescopic upright section and a load handling carrier means mounted for elevation relative to said second telescopic upright section, the improvement comprising a lift cylinder assembly mounted in the upright structure asymmetric thereof and operatively connected to said first telescopic upright section, first and second wheel elements operatively connected to said lift cylinder assembly, said first and second wheel elements being mounted in substantial longitudinal rotating alignment and spaced relation one to the other, sole flexible lifting means reeved on said first and second wheel elements, said first and second wheel elements being mounted in such a manner that one end of said flexible lifting means is secured substantially centrally of said second telescopic section and the other end means is secured a substantial distance outwardly of the one side of the lift cylinder assembly in a direction which includes a lateral component, said lift cylinder assembly being mounted intermediate the axes of rotation of said first and second wheel elements and being actuatable with the wheel elements and said flexible lifting means to elevate said second telescopic section relative to the first telescopic section and the latter section relative to the one upright section, the lift cylinder being located a substantial distance toward one lateral side of the upright structure such that it projects at least partially into the area of interference by an adjacent vertical rail with the visibility of the operator from his normal line of sight through said adjacent vertical rail, said normal line of sight being defined when the operator is located in a predetermined designed position and attitude for normal operation of the lift truck, and a second cylinder assembly for elevating said load carrier means on said second telescopic section.

37. In an upright structure for lift trucks and the like having a fixed upright section including transversely spaced vertical rails, a first telescopic upright section including transversely spaced vertical rails mounted for elevation relative to said fixed section, a second telescopic upright section including transversely spaced vertical rails mounted for elevation relative to said first telescopic section and elevatable load carrier means mounted for elevation relative to said second telescopic section, the improvement comprising first and second wheel elements mounted operatively from said first telescopic section in substantial longitudinal rotating alignment and spaced relation one to the other, sole flexible lifting means reeved on said first and second wheel elements, said first and second wheel elements being operatively mounted from said first telescopic section in such a manner that one end means of said flexible lifting means is secured substantially centrally of said second telescopic section and the other end means is secured in vertically fixed relation to the fixed upright section, and a lift cylinder assembly mounted in the upright structure asymmetric thereof and operatively connected to said first telescopic section intermediate the axes of rotation of said first and second wheel elements for actuating the wheel elements and said flexible lifting means to elevate said second telescopic section relative to the first telescopic section and the latter section relative to the fixed section, the lift cylinder assembly being located a substantial distance toward one lateral side of the upright structure such that it projects at least partially into the area of interference by an adjacent vertical rail with the visibility of the operator from his normal line of sight through said adjacent vertical rail, said normal line of sight being defined when the operator is located in a predetermined designed position and attitude for normal operation of the lift truck.

38. An upright structure as claimed in claim 37 wherein a second cylinder assembly is adapted to elevate said load carrier means relative to the second telescopic section independently of the elevation of the telescopic upright sections by said asymmetric cylinder assembly wheel element and flexible lifting means, and the run of said flexible lifting means which extends between said one end means thereof and the one wheel element being is located behind and in substantial longitudinal alignment with said second cylinder assembly.

being supported from the upper end portion of the first telescopic section.

10. An upright structure as claimed in claim 1 wherein wheel elements are mounted from said telescopic section, the flexible lifting means being reeved on said wheel elements.

11. An upright structure as claimed in claim 1 wherein wheel elements are mounted from the upper end of the cylinder assembly, said flexible lifting means being reeved on said wheel elements.

12. An upright structure as claimed in claim 11 wherein said load carrier means comprises a fork carriage, the upper end of the cylinder assembly being located a predetermined distance below the upper end of the telescopic section when the upright structure is in a collapsed condition, whereby free-lift of the fork carriage is effected during actuation of the flexible lifting means upon extension of the cylinder assembly prior to the operative connection thereof to the upper end of said telescopic section.

13. An upright structure as claimed in claim 3 wherein wheel elements are mounted from one of said telescopic sections, the flexible lifting means being reeved on said wheel elements.

14. An upright structure as claimed in claim 1 wherein said flexible lifting means is reeved on sprocket means and said wheel elements include at least two wheels mounted in substantial longitudinal rotating alignment and spaced relation one to the other, said cylinder assembly being mounted for extension intermediate the axes of rotation of said wheels.

15. An upright structure as claimed in claim 3 wherein said flexible lifting means is reeved on wheel elements and said wheel elements include at least two wheels mounted in substantial longitudinal rotating alignment and spaced relation one to the other, said cylinder assembly being mounted for extension intermediate the axes of rotation of said wheels.

16. An upright structure as claimed in claim 15 wherein said cylinder assembly is located intermediate said one and other end means of said flexible lifting means and intermediate said wheels in such a manner that the sum of lifting force moments acting on the upright structure are at least approximately balanced in the transverse plane of the upright and wherein said cylinder assembly applies a lifting force which is effectively and approximately midway between the central vertical plane of the load carrier means and the effective location of securement of said one end means.

17. An upright structure as claimed in claim 14 or 15 wherein said cylinder assembly is located intermediate said one and other end means of said flexible lifting means and intermediate said wheels in such a manner that the sum of lifting force moments acting on the upright structure are at least approximately balanced in the transverse plane of the upright.

18. An upright structure as claimed in claim 14 wherein said cylinder assembly is located intermediate said one and other end means of said flexible lifting means and intermediate said wheels in such a manner that the sum of lifting force moments acting on the upright structure are at least approximately balanced in the transverse plane of the upright and wherein said cylinder assembly applies a lifting force which is effectively and approximately midway between the central vertical plane of the load carrier means and the effective location of securement of said one end means.

19. An upright structure as claimed in claims 1 or 3 wherein said cylinder assembly is located intermediate said one and other end means of said flexible lifting means in such a manner that the lifting force of said cylinder assembly is approximately midway between the central vertical plane of the load carrier means and the effective location of securement of said one end means.

20. An upright structure as claimed in claims 1 or 3 wherein said flexible lifting means is reeved on wheel elements, and the operative connection of said cylinder assembly to said telescopic section in relation to said one and other end means is such that at least approximately balanced lifting force moments act on the upright structure in the transverse plane of the upright.

21. In an upright structure for lift trucks and the like having one upright section including transversely spaced vertical rails, a telescopic upright section including transversely spaced vertical rails mounted for elevation relative to said one section and elevatable load carrier means mounted for elevation relative to said telescopic section, the improvement comprising a lift cylinder assembly mounted in the upright structure asymmetric thereof and operatively connected to said telescopic upright section, first and second wheel elements operatively connected to said lift cylinder assembly, said first and second wheel elements being mounted in substantial longitudinal rotating alignment and spaced relation one to the other, sole flexible lifting means reeved on said first and second wheel elements, said first and second wheel elements being mounted in such a manner that one end of said flexible lifting means is secured substantially centrally of said load carrier means and the other end means is secured a substantial distance outwardly of the one side of the lift cylinder assembly in a direction which includes a lateral component, said lift cylinder assembly being mounted intermediate the axes of rotation of said first and second wheel elements and being actuatable with the wheel elements and said flexible lifting means to elevate said load carrier means relative to the telescopic upright section and the latter section relative to the one upright section, the lift cylinder being located a substantial distance toward one lateral side of the upright structure such that it projects at least partially into the area of interference by an adjacent vertical rail with the visibility of the operator from his normal line of sight through said adjacent vertical rail, said normal line of sight being defined when the operator is located in a predetermined designed position and attitude for normal operation of the lift truck.

22. An upright structure as claimed in claim 21 wherein said cylinder assembly projects into at least a portion of the longitudinal plane of said adjacent vertical rail on the said one side of the upright structure.

23. An upright structure as claimed in claim 21 wherein the sole substantial interference with operator visibility through that portion of the upright structure which comprises said cylinder assembly and telescopic section is a single run of said flexible lifting means when the load carrier means is lowered.

24. An upright structure as claimed in claim 21 wherein said other end means of said flexible lifting means is secured outwardly of the one side of the upright structure.

25. An upright structure as claimed in claim 21 wherein said first and second wheel elements are mounted from said telescopic upright section, said lift 39. An upright structure as claimed in claim 38 wherein said second cylinder means is a cantilevered cylinder means operating a second sole flexible lifting means which is operatively connected to the second telescopic section and to the load carrier means for elevating the load carrier means on the latter section, said second sole flexible lifting means being in substantial longitudinal alignment with the said run of the first mentioned sole flexible lifting means.

40. An upright structure as claimed in claim 38 wherein inverted U-shaped conduit means connects hydraulically the base ends of the first and second lift cylinder assemblies, said conduit means being supported from the upper end portion of the first telescopic section.

41. An upright structure as claimed in claim 37 wherein the connection of said asymmetric cylinder assembly to said first telescopic section in relation to said first and second wheel elements is such that the sum of lifting force moments acting on the upright structure are at least approximately balanced in the transverse plane of the upright.

42. An upright structure as claimed in claim 41 wherein said asymmetric cylinder assembly is connected at least approximately centrally of the projected said one and other end means of said flexible lifting means.

* * * * *